US005941798A

United States Patent [19]

Coan et al.

[11] Patent Number: 5,941,798

[45] Date of Patent: Aug. 24, 1999

[54] SAFETY NET FOR TRAMPOLINES

[76] Inventors: Rory Coan; Tammy L. Coan, both of 7611 Lovelady Rd., Dadeville, Ala. 36853

[21] Appl. No.: 09/168,453

[22] Filed: Oct. 8, 1998

[51] Int. Cl.[6] ..... A63B 5/11

[52] U.S. Cl. ..... 482/27; 482/28; 482/29; 482/77

[58] Field of Search ..... 482/27, 77, 28, 482/29; 446/220, 221; 441/40, 41; 5/449, 455; 160/135

[56] References Cited

U.S. PATENT DOCUMENTS

| | | | |
|---|---|---|---|
| D. 187,138 | 2/1960 | Highberger | 482/27 |
| 4,386,772 | 6/1983 | Wu | 482/27 |
| 4,623,126 | 11/1986 | Petlit | 256/125 |
| 4,982,813 | 1/1991 | Sturr | 182/138 |
| 5,102,103 | 4/1992 | Putman | 256/12 |
| 5,395,105 | 3/1995 | Thommen, Jr. | 256/25 |
| 5,399,132 | 3/1995 | Bailey | 482/29 |
| 5,813,946 | 9/1998 | Lin et al. | 482/27 |

*Primary Examiner*—Jerome Donnelly

[57] ABSTRACT

A trampoline with safety net is provided including a trampoline frame with a plurality of stanchions. Also included is a trampoline mat having a periphery connected to the trampoline frame via a plurality of springs connected. Further included is a trampoline net assembly situated within a horizontal plane, wherein an area enclosed by the net assembly is substantially larger than that enclosed by the trampoline frame. The trampoline net assembly further includes a plurality of supports for maintaining the net assembly at an elevation above that of the trampoline frame. Finally, a trampoline net is provided having an inverted frusto configuration and connected to the trampoline assembly and extending downwardly and inwardly therefrom.

5 Claims, 3 Drawing Sheets

SAFETY NET FOR TRAMPOLINES

BACKGROUND OF THE INVENTION

1. Field of the Invention

The present invention relates to net enclosures and more particularly pertains to a new SAFETY NET FOR TRAMPOLINES for preventing injury associated with falling off a trampoline during its use.

2. Description of the Prior Art

The use of net enclosures is known in the prior art. More specifically, net enclosures heretofore devised and utilized are known to consist basically of familiar, expected and obvious structural configurations, notwithstanding the myriad of designs encompassed by the crowded prior art which have been developed for the fulfillment of countless objectives and requirements.

Known prior art net enclosures include U.S. Pat. Nos. 5,399,132; 4,623,126; 5,395,105; 4,386,772; 5,102,103; and 4,982,813.

In these respects, the SAFETY NET FOR TRAMPOLINES according to the present invention substantially departs from the conventional concepts and designs of the prior art, and in so doing provides an apparatus primarily developed for the purpose of preventing injury associated with falling off a trampoline during its use.

SUMMARY OF THE INVENTION

In view of the foregoing disadvantages inherent in the known types of net enclosures now present in the prior art, the present invention provides a new SAFETY NET FOR TRAMPOLINES construction wherein the same can be utilized for preventing injury associated with falling off a trampoline during its use.

The general purpose of the present invention, which will be described subsequently in greater detail, is to provide a new SAFETY NET FOR TRAMPOLINES apparatus and method which has many of the advantages of the net enclosures mentioned heretofore and many novel features that result in a new SAFETY NET FOR TRAMPOLINES which is not anticipated, rendered obvious, suggested, or even implied by any of the prior art net enclosures, either alone or in any combination thereof.

To attain this, the present invention generally comprises a trampoline frame with a plurality of interconnected linear members that reside within a horizontal plane. A plurality of vertically oriented stanchions are each coupled to and extended downwardly from an associated one of a plurality of interconnections between the linear members for supporting the linear members of the frame at an elevated orientation. As shown in FIG. 5, each stanchion has a circular plate mounted to a bottom end thereof and an L-shaped spring mount situated on a top end thereof. Further provided is a trampoline mat having a periphery with a plurality of interconnected linear edges having a combined shape similar to that of the linear members of the trampoline frame. The trampoline mat is connected to the trampoline frame via a plurality of springs. Each of such springs is connected each at a first end thereof to an associated one of the spring mounts. A second end of each spring is connected to an associated one of a plurality of interconnections between the linear edges of the trampoline mat. Also included is a trampoline net assembly with a plurality of interconnected linear bars that reside within a horizontal plane. It is imperative that an area enclosed by the linear bars of the trampoline net assembly be substantially larger than that enclosed by the linear members of the trampoline frame. The trampoline net assembly further includes a plurality of supports. Each of the supports has a first end connected to an associated one of a plurality of interconnections between the linear bars and a second end coupled to a bottom end of an associated one of the stanchions of the trampoline frame. As shown in the Figures, the supports extends downwardly and inwardly from top ends to the bottom ends thereof. For constraining a user when utilizing the trampoline, a trampoline net is provided. The net has an inverted frusto configuration with a plurality of interconnected planar extents. Each of the planar extents is equipped with a linear bottom edge coupled to an associated one of the linear edges of the trampoline mat. Associated therewith is a linear upper edge coupled to an associated one of the linear bars of the trampoline net assembly. As shown in FIGS. 1 & 2, the bottom edge of the trampoline net is situated downwardly and inwardly with respect to the upper edge thereof. For allowing a user to access the trampoline mat, one of the planar extents of the trampoline net has a flap formed therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new SAFETY NET FOR TRAMPOLINES apparatus and method which has many of the advantages of the net enclosures mentioned heretofore and many novel features that result in a new SAFETY NET FOR TRAMPOLINES which is not anticipated, rendered obvious, suggested, or even implied by any of the prior art net enclosures, either alone or in any combination thereof.

It is another object of the present invention to provide a new SAFETY NET FOR TRAMPOLINES which may be easily and efficiently manufactured and marketed.

It is a further object of the present invention to provide a new SAFETY NET FOR TRAMPOLINES which is of a durable and reliable construction.

An even further object of the present invention is to provide a new SAFETY NET FOR TRAMPOLINES which is susceptible of a low cost of manufacture with regard to both materials and labor, and which accordingly is then susceptible of low prices of sale to the consuming public, thereby making such SAFETY NET FOR TRAMPOLINES economically available to the buying public.

Still yet another object of the present invention is to provide a new SAFETY NET FOR TRAMPOLINES which provides in the apparatuses and methods of the prior art some of the advantages thereof, while simultaneously overcoming some of the disadvantages normally associated therewith.

Still another object of the present invention is to provide a new SAFETY NET FOR TRAMPOLINES for preventing injury associated with falling off a trampoline during its use.

Even still another object of the present invention is to provide a new SAFETY NET FOR TRAMPOLINES that includes a trampoline frame with a plurality of stanchions. Also included is a trampoline mat having a periphery connected to the trampoline frame via a plurality of springs connected. Further included is a trampoline net assembly situated within a horizontal plane, wherein an area enclosed by the net assembly is substantially larger than that enclosed by the trampoline frame. The trampoline net assembly further includes a plurality of supports for maintaining the net assembly at an elevation above that of the trampoline frame. Finally, a trampoline net is provided having an inverted frusto configuration and connected to the trampoline assembly and extending downwardly and inwardly therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
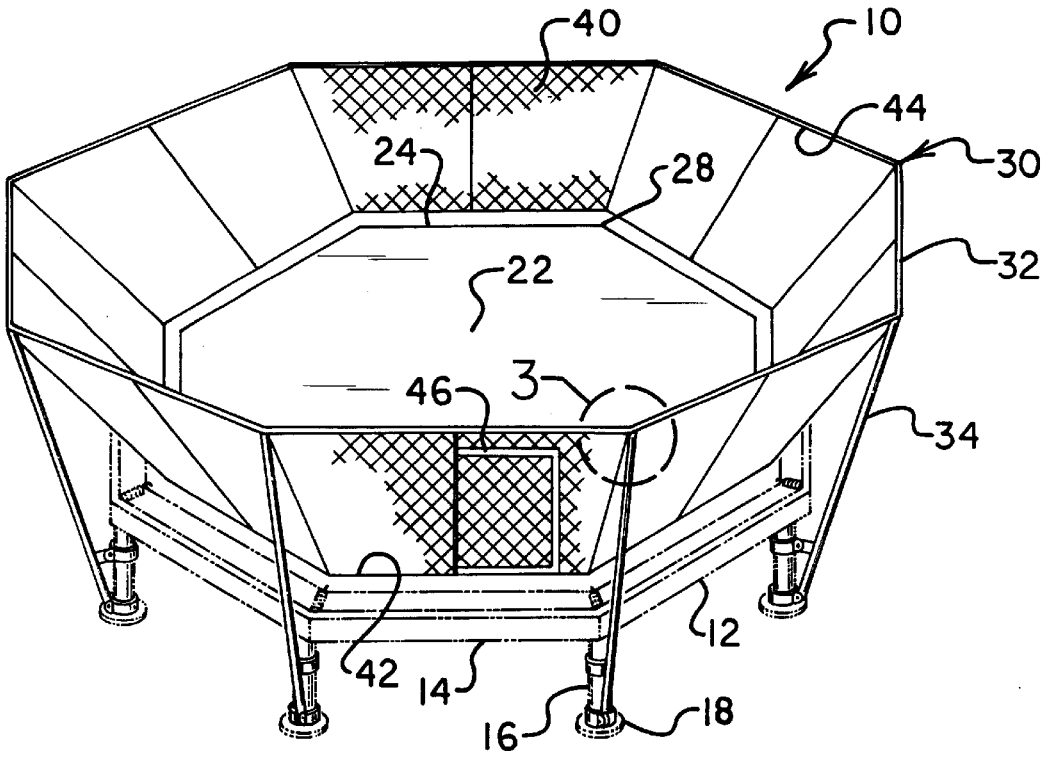
FIG. 1 is a perspective view of a new SAFETY NET FOR TRAMPOLINES according to the present invention.

With reference now to the drawings, a new SAFETY NET FOR TRAMPOLINES embodying the principles and concepts of the present invention and generally designated by the reference numeral will be described.

Figure 5:
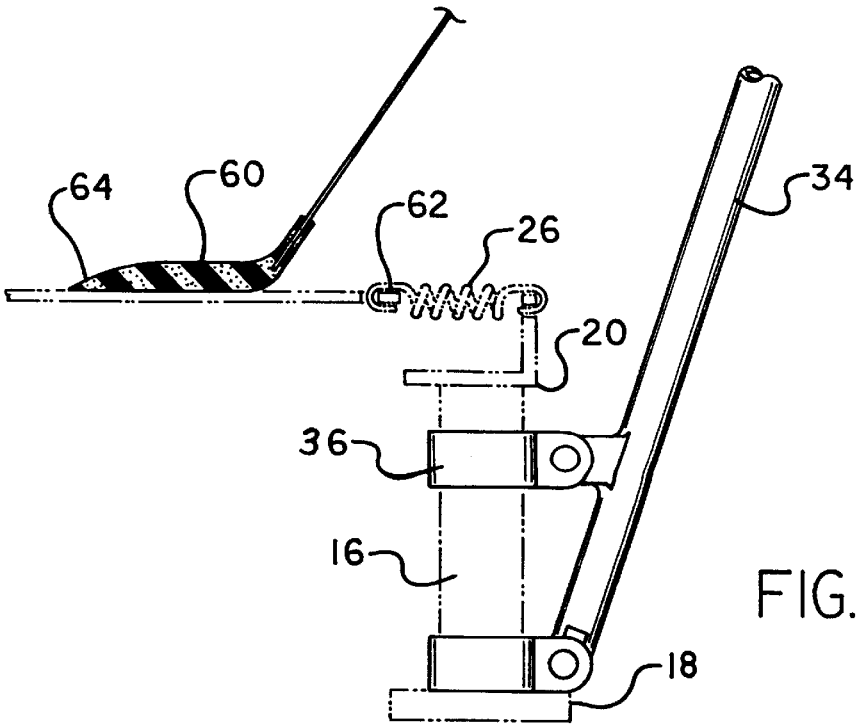
FIG. 5 is a side close up view of the interconnection between the trampoline frame and net assembly of the present invention.

As shown in the Figures, a trampoline frame 12 is provided including a plurality of interconnected linear members 14 that reside within a horizontal plane. In the preferred embodiment, the linear members define an octagon. As an alternative, the linear members may be replaced with an annular loop. A plurality of vertically oriented stanchions 16 are each coupled to and extended downwardly from an associated one of a plurality of interconnections between the linear members for supporting the linear members of the frame at an elevated orientation. As shown in FIG. 5, each stanchion has a circular plate 18 mounted to a bottom end thereof and a horizontal extent of an L-shaped spring mount 20 situated on a top end thereof.

Further provided is a trampoline mat 22 having a periphery with a plurality of interconnected linear edges 24 having a combined shape similar to that of the linear members of the trampoline frame. The trampoline mat is connected to the trampoline frame via a plurality of springs 26. Each of such springs is connected each at a first end thereof to a vertical extent of an associated one of the L-shaped spring mounts. A second end of each spring is connected to an associated one of a plurality of interconnections between the linear edges of the trampoline mat. Such interconnections take the form of corners 28.

Also included is a trampoline net assembly 30 with a plurality of interconnected linear bars 32 that reside within a horizontal plane. The shape that the linear bars define is similar to that defined by the linear members of the trampoline frame. Further, it is imperative that an area enclosed by the linear bars of the trampoline net assembly be substantially larger than that enclosed by the linear members of the trampoline frame. The trampoline net assembly further includes a plurality of supports 34. Each of the supports has a first end connected to an associated one of a plurality of interconnections between the linear bars and a second end coupled to a bottom end of an associated one of the stanchions of the trampoline frame. The coupling with the bottom edge of the stanchions is facilitated by a bracket including a pair of O-rings 36 each coupled about the corresponding stanchion and to the support. As shown in the Figures, the supports extends downwardly and inwardly from the top ends to the bottom ends thereof.

For constraining a user when utilizing the trampoline, a trampoline net 40 is provided. The net has an inverted frusto configuration with a plurality of interconnected planar extents. Each planar extent ideally forms between a 60–75 degree angle with respect to the horizontal. In the preferred embodiment, the planar extents form a portion of an inverted 8-sided pyramid. Each of the planar extents is equipped with a linear bottom edge 42 coupled to an associated one of the linear edges of the trampoline mat. Associated therewith is a linear upper edge 44 coupled to an associated one of the linear bars of the trampoline net assembly.

Figure 2:
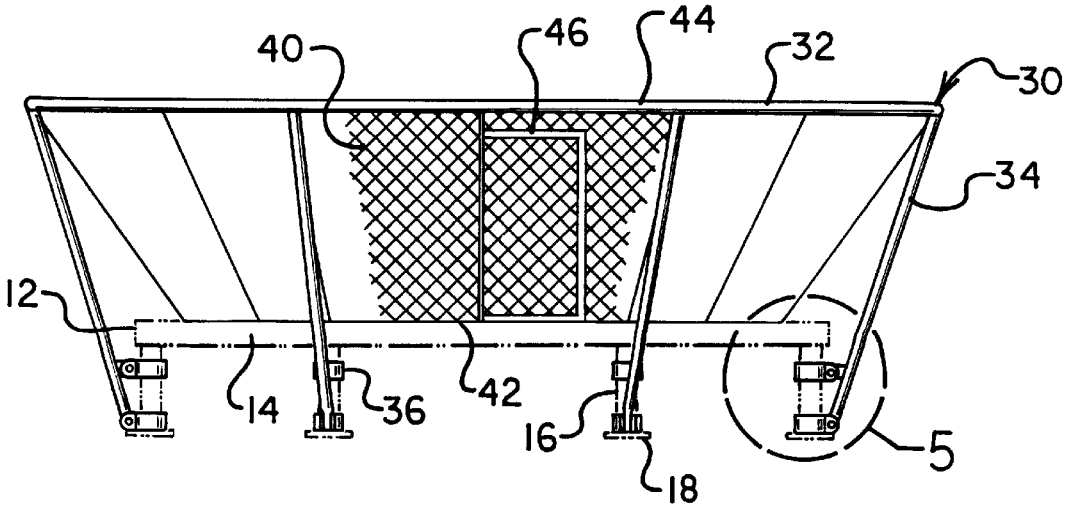
FIG. 2 is a side view of the present invention.
Figure 6:
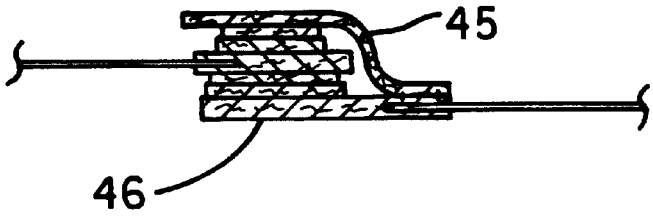
FIG. 6 is a cross-sectional view of the flap associated with the net of the present invention.
Figure 7:
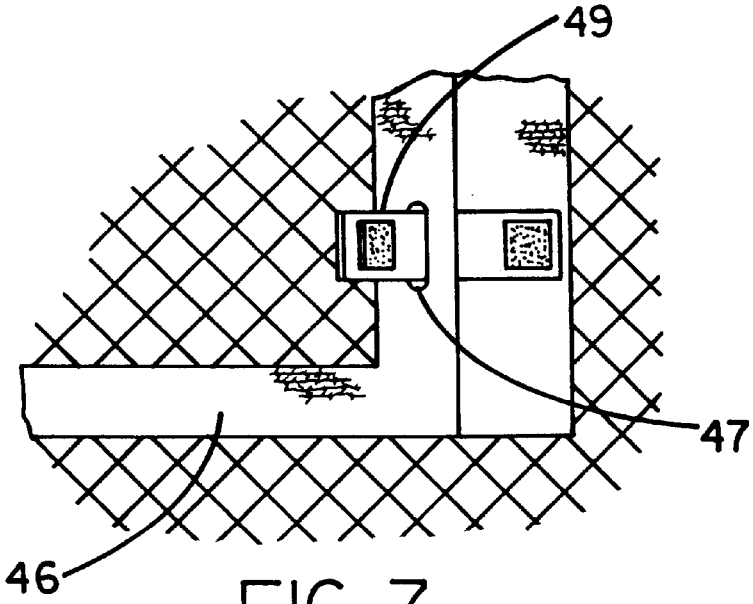
FIG. 7 is an illustration of an alternate form of coupling associated with the flap.
Figure 8:
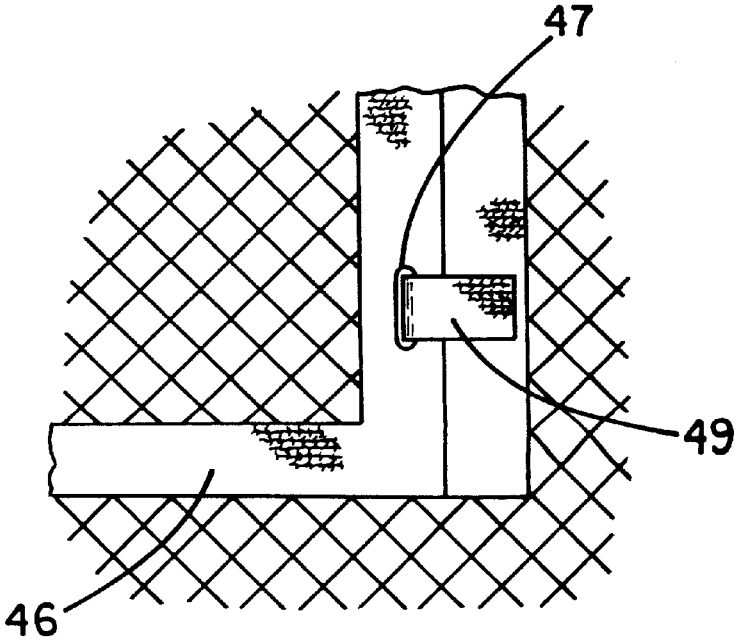
FIG. 8 is a close-up view of the alternate form of coupling shown in FIG. 7.

As shown in FIGS. 1 & 2, the bottom edge of the trampoline net is situated downwardly and inwardly with respect to the upper edge thereof. For allowing a user to access the trampoline mat, one of the planar extents of the trampoline net has a flap 46 formed therein. FIG. 6 shows the VELCRO coupling which is utilized to maintain the flap closed when in use. It can be seen that multiple over lapping layers 45 of VELCRO are necessary to maintain a robust coupling. In the alternative, the flap may be equipped with reinforced slits 47 through which loops 49 may be situated for providing a coupling with the remaining portion of the net.

Figure 3:
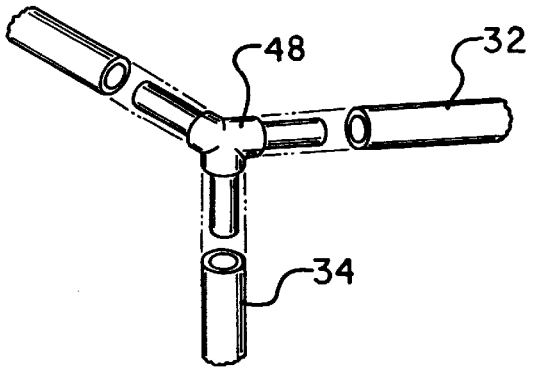
FIG. 3 is a close up view of the trampoline net assembly of the present invention in a disassembled orientation.
Figure 4:
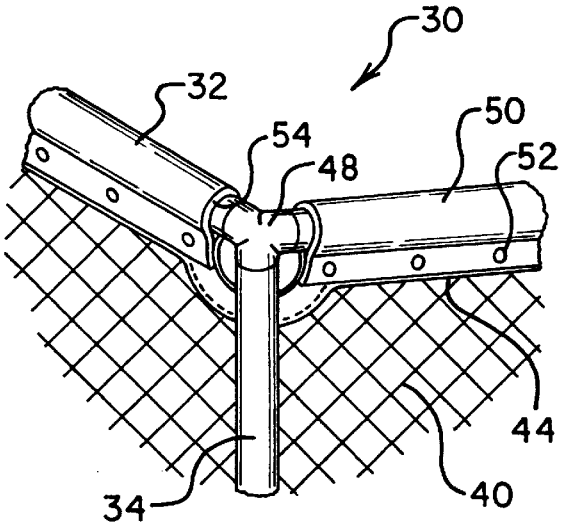
FIG. 4 is a close up view of the trampoline net assembly of the present invention in an assembled orientation.

With reference to FIGS. 3 & 4, it can be seen that the linear bars and supports of the trampoline net assembly are releasably interconnected by way of a plurality of T-shaped interconnects 48. Further, the upper edge of each planar extent of the trampoline net is equipped with an elongated flap 50 having a first edge coupled thereto and a second edge having a plurality of snaps 52 situated thereon for releasably coupling with another set of snaps situated on the upper edge of the net. When the snaps are connected, the flaps each define a closed sleeve 54 through which an associated linear bar of the trampoline net assembly may be slid.

FIG. 5 shows the bottom edge of the net equipped with a pad 60. Such pad extends along the net tire length of the bottom edge of the net. Each pad also includes a loop 62 coupled to a bottom surface thereof for coupling to the corners of the trampoline net adjacent the springs. In the preferred embodiment, the pad is constructed from an elastomeric material and has a tapered inner peripheral edge 64.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A trampoline with safety net comprising, in combination:

a trampoline frame including a plurality of interconnected linear members that reside within a horizontal plane and a plurality of vertically oriented stanchions each coupled to and extending downwardly from an associated one of a plurality of interconnections between the linear members, each stanchion having a circular plate mounted to a bottom end thereof and an L-shaped spring mount situated on a top end thereof;

a trampoline mat having a periphery with a plurality of interconnected linear edges, the trampoline mat connected to the trampoline frame via a plurality of springs connected each at a first end thereof to an associated one of the spring mounts and at a second end thereof to an associated one of a plurality of interconnections between the linear edges of the trampoline mat;

a trampoline frame assembly including a plurality of interconnected linear bars that reside within a horizontal plane wherein an area enclosed by the linear bars of the trampoline frame assembly is substantially larger than that enclosed by the linear members of the trampoline frame, the trampoline frame assembly further including a plurality of supports each having a first end connected to an associated one of a plurality of interconnections between the linear bars and a second end coupled to a bottom end of an associated one of the stanchions of the trampoline frame, the supports extending downwardly and inwardly from top ends to the bottom ends thereof; and a trampoline net having a plurality of interconnected planar extents each with a linear bottom edge coupled to an associated one of the linear edges of the trampoline mat and a linear upper edge coupled to an associated one of the linear bars of the trampoline frame assembly such that the trampoline net has an inverted frusto configuration, one of the planar extents of the trampoline net having a flap formed therein for allowing a user to access the trampoline mat;

wherein the bottom edge of the trampoline net is situated downwardly and inwardly with respect to the upper edge thereof.

2. A trampoline with safety net comprising:

a trampoline frame with a plurality of stanchions;

a trampoline mat having a periphery connected to the trampoline frame via a plurality of springs;

a trampoline frame assembly including an upper peripheral portion situated within a horizontal plane wherein an area enclosed by the upper peripheral portion of the trampoline frame assembly is substantially larger than that enclosed by the trampoline frame, the trampoline frame assembly further including a plurality of supports for maintaining the upper peripheral portion of the trampoline frame assembly at an elevation above that of the trampoline frame; and a trampoline net connected to the upper peripheral portion of the trampoline frame assembly and extending downwardly and inwardly therefrom such that the trampoline net has a substantially inverted frusto configuration.

3. A trampoline with safety net as set forth in claim 2 wherein the trampoline net has a flap formed therein for allowing a user to access the trampoline mat.

4. A trampoline with safety net as set forth in claim 2 wherein the supports of the trampoline frame assembly are coupled to the stanchions of the trampoline frame.

5. A trampoline safety net assembly adapted for use with a trampoline frame with a plurality of stanchions and a trampoline mat having a periphery connected to the trampoline frame via a plurality of springs, the safety net assembly comprising:

a trampoline frame assembly including an upper peripheral portion situated within a horizontal plane wherein an area enclosed by the inner peripheral portion of the net assembly is substantially larger than that enclosed by the trampoline frame, the trampoline frame assembly further including a plurality of supports for maintaining the upper peripheral portion of the trampoline frame assembly at an elevation above that of the trampoline frame; and a trampoline net connected to the upper peripheral portion of the trampoline frame assembly and extending downwardly and inwardly therefrom such that the trampoline net has a substantially inverted frusto conical configuration.

* * * * *